US006158183A

United States Patent [19]

Snell

[11] Patent Number: 6,158,183

[45] **Date of Patent: *Dec. 12, 2000**

[54] RESILIENT PANELS

[76] Inventor: Thomas Bartlett Snell, Snell 2000, Torbay Road Industrial Estate, Castle Cary, Somerset BA7 7DW, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/800,628

[22] Filed: Feb. 14, 1997

[51] Int. Cl.[7] ..... E04B 2/00

[52] U.S. Cl. ..... 52/268; 52/417; 52/459; 52/794.1

[58] Field of Search ..... 52/416, 417, 459, 52/471, 586.1, 586.2, 794.1, 265, 267, 268

[56] References Cited

U.S. PATENT DOCUMENTS 2,878,666 3/1959 Drummond ..... 52/391
3,310,917 3/1967 Simon ..... 52/586.1
3,350,828 11/1967 Russell ..... 52/471
5,052,158 10/1991 D'Luzansky ..... 52/392
5,600,930 2/1997 Drucker ..... 52/586.2

*Primary Examiner*—Michael Safavi
*Attorney, Agent, or Firm*—Jones Volentine, LLP

[57] ABSTRACT

A panel for a padded enclosure, such as a large animal treatment room in veterinary practices, has a resilient body with an impermeable skin or a plastics coating (5) over one face (1) and the edges (2). The edges have longitudinal grooves (4) and the coating follows them so that when two panels are placed edge to edge there is a concealed void. These edges (2) are adhered and sealed together when lining the enclosure, coated faces innermost, but the sealant/adhesive (6) does not fill the voids. These voids compensate for the stiffness that would be inherent in a plain coated edge and make the cushioning effect of the padding substantially uniform.

10 Claims, 3 Drawing Sheets

RESILIENT PANELS

This invention relates to resilient panels. It was developed primarily for making padded rooms for large animal veterinary practices, and it will be described mostly in those terms. However, it could have other applications, as will be briefly mentioned later.

Large animals, particularly horses when anaesthetised for surgery, benefit from a padded room to minimise the impact when they collapse on to the floor. The horse is then operated on in the padded room, either on the floor or on a suitable operating table. Alternatively, it may be transported by hoist to an operating theatre adjacent the padded room. After surgery, the horse is left to come round in the padded room, and when it first stands up it is naturally unsteady. It can lunge towards or fall against the walls of the room, and therefore they too are padded, The aim behind this invention is to provide a modular system of padding that can be simply and economically fitted with relatively low skill.

According to the present invention there is provided a panel comprising a resilient body with a coating of different material to make at least one face and edge fluid impermeable, that edge having an indentation along its length between said faces.

Preferably there is a sloping transition between each coated face and edge, and this may be provided by radiussing, a chamfer, or by the edge itself not being at right angles to the face.

The body may be unitary or a lamination of more than one sheet. As shown in FIG. 7 if there are three laminated sheets 12, 13 and 14, the intermediate one can be smaller than the others, whose overlaps form the indentation 4. Generally, the panel will be square or rectangular, with indentations along all four edges. But other shapes are possible, and it might not be necessary to indent every edge.

Preferably the coating is a polyurethane elastomer. It may be reinforced by a flexible mesh or permeable fabric concealed therein. When applying the coating, as by spraying, this can be used to gauge the correct thickness: that is achieved when the mesh or fabric is completely concealed.

Conveniently, at least some indented edges slant with respect to said faces over at least some depth of the panel. A padded enclosure can be created by sheathing its interior surface at least partially by such panels. The panels will be arranged with coated faces innermost and with indented edges abutting or nearly so, these edges being at least partially sealed and adhered together leaving a void within the indentations.

When there is a sloping transition between each coated face and edge, a sealant/adhesive can be applied to the grooves formed at abutting edges, or a flexible bead may be adhered within those grooves.

If the edges were flat surfaces perpendicular to the main faces of the panels, and if they were coated by the same material as coats said one face, they would be stiff, and more resistant to deformation normal to the panel than the central area of the panel. With panels set edge to edge, this stiffness would be further increased. The indentations compensate for this and reduce the stiffness and make the cushioning substantially even. This is particularly desirable on the floor of a padded room, to avoid hard spots or lines which might adversely affect a post-operative horse.

Even so, there can be problems with rough usage damaging the seals. This can be ameliorated by using panels whose edges have complementary positive and negative slants especially for panels used on floors. Treading on the joints is then less likely to shear the panels apart.

For a better understanding of the invention, one embodiment will now be described, by way of example, with reference to the accompanying drawings, in which.

Figure 1:
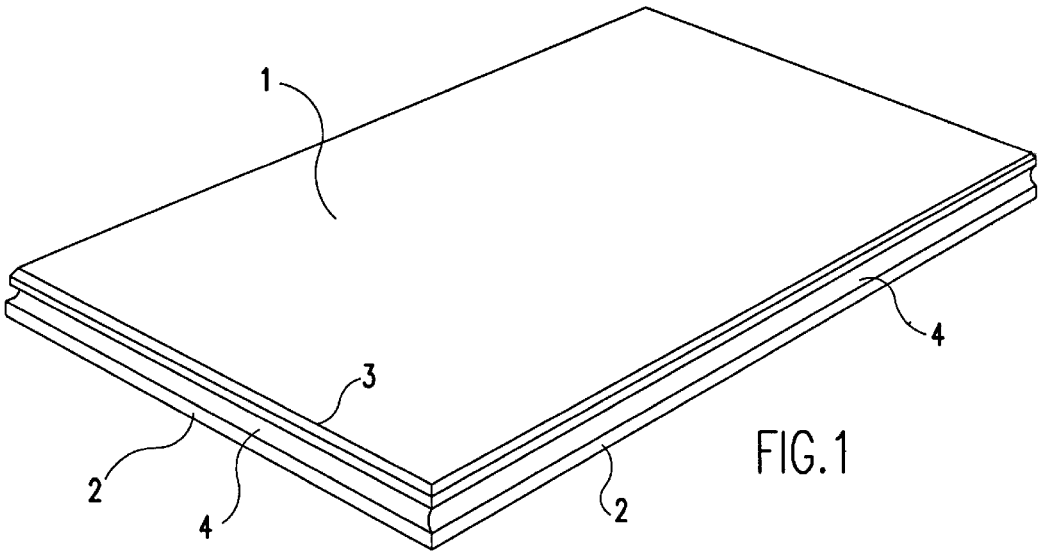
FIG. 1 is a perspective view of a cushioning panel.
Figure 2:
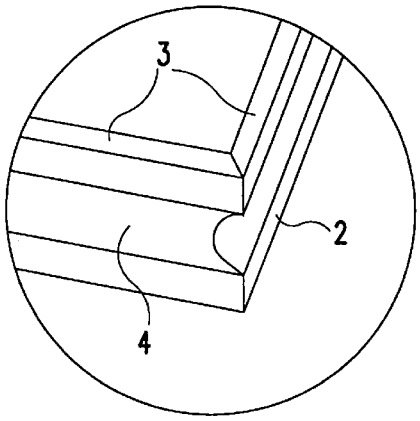
FIG. 2 is a detail of a corner of such a panel.
Figure 3:
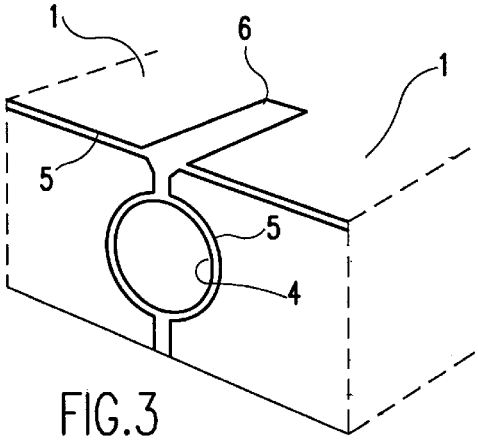
FIG. 3 is a perspective section of a junction between two similar panels.

The panel of FIG. 1 is rectangular with a main face 1 which will be exposed in the padded enclosure. The edges 2 are generally perpendicular to this face 1, but at their junctions with the face there are chamfers 3. There may also be chamfers at the junctions with the face opposite the main one. Also, running along the entire length of each edge at an intermediate depth, there is a groove 4. As shown in the figures, this is C shaped, but it can have other configurations.

The main body of the panel is foamed plastics (open or closed cell) or of other resilient material, which may be made up from laminated sheets, as mentioned above. It is beneficial if the panels quickly recover their shape after being indented, and a particularly satisfactory foam is an ethylene vinyl acetate (EVA) co-polymer foam known as EVAZOTE. But currently this is only available with a maximum thickness of 30 mm, and although it would be possible to use two (or more) such sheets laminated together, it is satisfactory to have the EVA foam on top and another less expensive foam, such as closed cell polyethylene foam, below. The foam body is sheathed over the face 1 and the edges 2 by a coating 5 of polyurethane elastomer. The coating could extend over the reverse face not visible in the figures, but this is not generally necessary. It should be noted that the coating follows the chamfers 3 and the grooves 4 and is of substantially even thickness throughout. It may be applied in liquid form by spraying, moulding, casting or floating, and it may be reinforced by a flexible mesh or permeable fabric. A knotted net may be particularly advantageous, especially when spraying the coating, since the correct thickness may be reckoned to be achieved when the knots are covered and do not show as bumps on the surface. Alternatively, a flexible sheet may be adhered to the foamed plastics.

Figure 4:
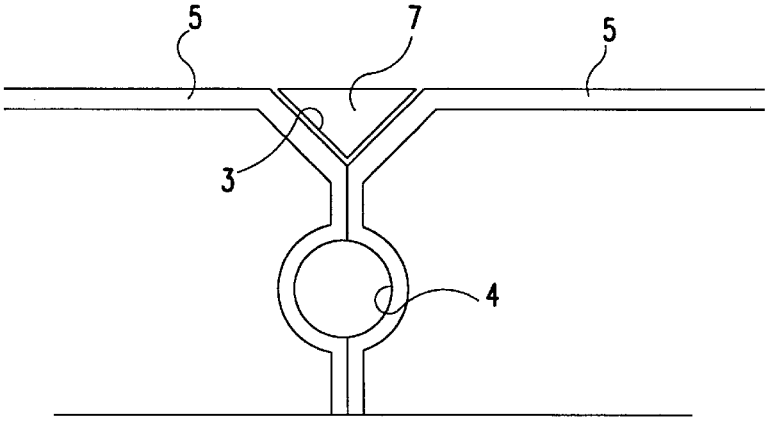
FIG. 4 is a cross-section of an alternative junction between two similar panels.
Figure 5:
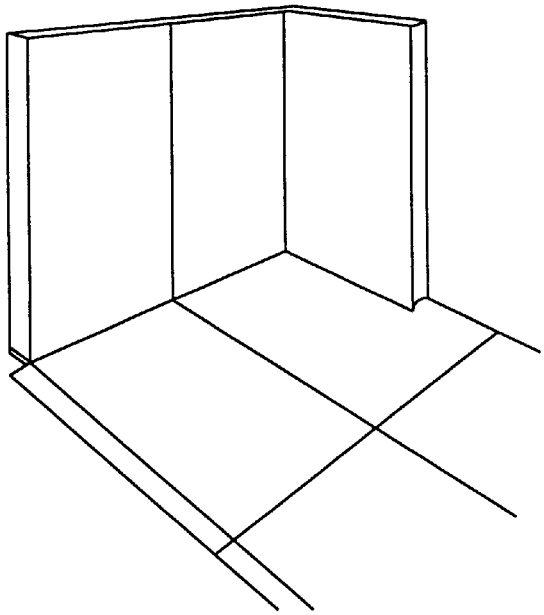
FIG. 5 is a perspective view of an assembly of such panels partially lining a room.

Such panels are applied in grid fashion to the floor and walls of a room as indicated by FIG. 4. Usually, the floor will be done first, and although the panels may be adhered to it, this is not essential. Obviously, with a single coated face that is uppermost. In one technique the abutting edges are sealed together by a gun dispenser being run along the abutment lines applying a sealant/adhesive 6. There may be just a single run, filling in the V groove formed by the chamfers 3 or there may be two runs, the first with the nose of the gun forced between the adjacent panels and across the grooves 4 to apply sealant/adhesive between the lower portions of the abutting edges, particularly if they too are chamfered. The grooves 4 are not filled with adhesive/sealant; they are either left empty or a 'string' of very low density material, much softer than the foamed plastics of the panel, is placed in them. This has little effect on the resilience at the panel edges, but it can serve as a stop to prevent sealant/adhesive seeping down partially to fill the grooves 4.

In another technique a pre-formed flexible bead 7 of triangular cross-section to fit the V-grooves formed by the chamfers 3 is adhered into those grooves as illustrated in FIG. 4.

It will be rare for complete panels to fit the room exactly, but they can be cut to size. Wherever possible the cut edges will be placed against the walls, where they will be concealed by the upright panels. However, a cut edge can be joined to a sealed edge, and preferably sealant will cover all but the band registering with the indentation.

When the floor is complete, those upright panels are adhered to the walls and sealed together in like manner. At the wall/floor junction and at wall corners, there will generally be left a bead of sealant, but that is not a problem. It is inaccessible to horses. Doors can also be sheathed by such panels.

When complete, the cushioned area is totally sealed and waterproof, with no hidden traps for bacteria. It can be washed down with high pressure hoses and with selected disinfectants.

Wall panels may be of different quality and thickness from floor panels, although generally it will be convenient to use the same type of panel throughout. But if only one row of wall panels is required, their top and bottom edges do not really need the indentations (indeed along the top edges they would form an undesirable water trap), and so those indentations may be provided only along the vertical edges.

Although cutting to size will often be necessary, to avoid too much waste such panels may be made in a range of sizes. Different shapes, such as hexagonal and triangular, are also possible.

Figure 6:
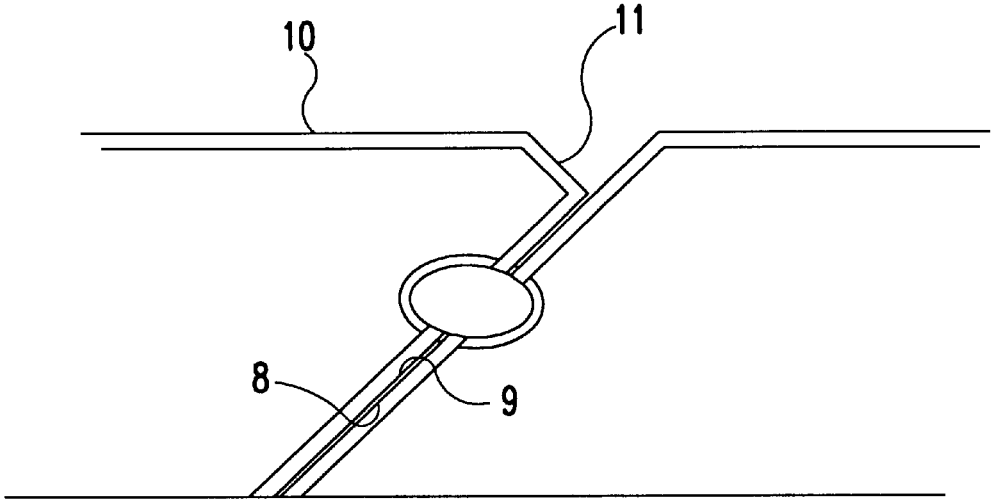
FIG. 6 is a cross-section of another junction between panels.
Figure 7:
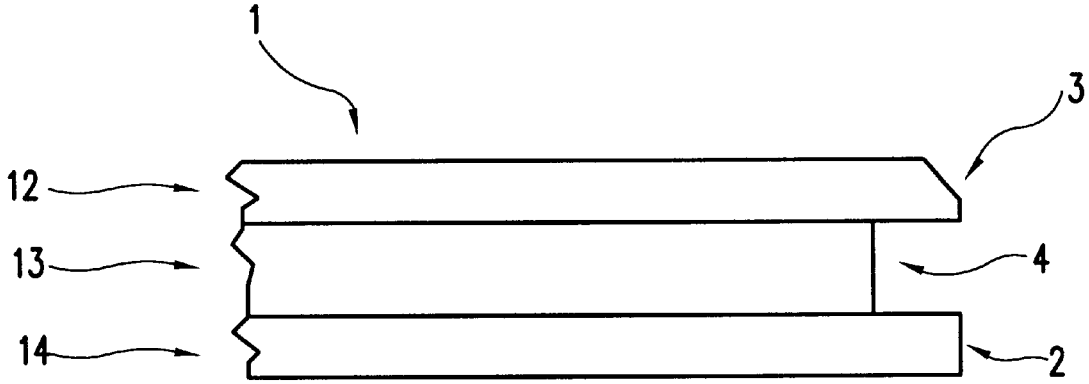
FIG. 7 is a cross-section of one embodiment of a cushioning panel.

Although having the edges 2 at right angles to the face 1 is the most convenient form of panel and are generally satisfactory for wall panels, the joins between floor panels are sources of possible weakness. A proposal to overcome this is illustrated in FIG. 6. Here the adjacent edges 8, 9 are at a slant of 45°, although other angles may be adopted. This means that a downward force at the join is not so likely to shear it apart. The edge 8 which slopes back under the top face 10 of its panel has a chamfer 11 at its junction with that top face but no chamfer is necessary for the other edge 9. The V groove will be filled as described above.

For convenience edges such as the edge 8 will be referred to as negative slant edges while the edge 9 will be called a positive slant edge.

Panels could be made with all positive or all negative slants, and obviously both kinds would be needed to fit out a room. Alternatively, panels could have a mixture, and rectangular panels with positive slants along two adjacent edges and negative slants along the other two edges could be assembled grid fashion. If the panels were square, the matching edges could be opposite one another. But for certain positions, such as at doorways, it might be desirable to have a vertical edge, and panels could have a mixture of vertical and sloping edges. In a further variation, an edge may slant down to the indentation and thereafter continue at right angles to the main face.

The slant-edged panels reduce the need for the grooves 4 in proportion to their slope, but do not eliminate them entirely. There is bound to be a component of extra vertical stiffness for which compensation is needed.

Generally, as indicated above, the slant-edged panels will be used for floors; walls are unlikely to receive such punishing treatment and it will generally be satisfactory to use panels with edges at right angles to the main face. Wall panels may also be of a different thickness from the floor panels.

The panels can be used loose, in which case they would be coated on all faces and the compensating grooves 4 would not have to be so large. They would provide the auxiliary function of presenting a finger grip for lifting the panel without prising right underneath it.

Other uses include swimming pools and their surrounds, exercise or gym mats, padded cells for human use, children's play areas and anywhere, domestic or industrial, that requires a resilient floor, wall or cushion.

I claim:

1. A panel comprising:

a resilient body having opposite first and second principal surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, first and second planar surface portions respectively extending on opposite sides of said concave surface portion and lengthwise in a direction parallel to said opposing edges of said first and second principal surfaces; and a third planar surface portion extending widthwise at an angle relative to said first planar surface portion and extending lengthwise between an edge of said first principal surface and said first planar surface portion; and a fluid impermeable coating covering at least said first principal surface, said third planar surface portion, and at least a portion of said at least one of said plurality of side surfaces.

2. A panel comprising:

a resilient body having opposite first and second principal surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, and first and second planar surface portions respectively extending on opposite sides of said concave surface portion and lengthwise in a direction parallel to said opposing edges of said first and second principal surfaces; and a fluid impermeable coating covering at least one of said first and second principal surfaces and covering at least a portion of said at least one of said plurality of side surfaces;

wherein said resilient body is a lamination of more than one sheet.

3. A panel as claimed in claim 2, wherein said lamination comprises three sheets, a first of said three sheets defining said first principal surface, a second of said three sheets defining said second principal surface, and a third of said three sheets laminated between said first and second sheets, wherein a dimension of said third sheet is less than that of said first and second sheets such that an edge of each of said first and second sheets overlaps an edge of said third sheet to define said concave surface region.

4. A panel comprising:

a resilient body having opposite first and second principal surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, and first and second planar surface portions respectively extending on opposite sides of said concave surface portion and lengthwise in a direction parallel to said opposing edges of said first and second principal surfaces; and a fluid impermeable coating covering at least one of said first and second principal surfaces and covering at least a portion of said at least one of said plurality of side surfaces;

wherein said coating is reinforced by a flexible mesh or permeable fabric concealed therein.

5. A panel comprising:

a resilient body having opposite first and second principal surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, and first and second planar surface portions respectively extending on opposite sides of said concave surface portion and lengthwise in a direction parallel to said opposing edges of said first and second principal surfaces; and a fluid impermeable coating covering at least one of said first and second principal surfaces and covering at least a portion of said at least one of said plurality of side surfaces;

wherein at least one of said first and second planar surface portions extends widthwise in a direction which is oblique relative to said first and second principal surfaces.

6. A panel as claimed in claim 1, wherein said first and second planar surface portions extend widthwise in a same plane and in a direction which is oblique relative to said first and second principal surfaces.

7. A padded enclosure comprising an interior surface which is at least partially sheathed by a plurality of panels, each of said panels comprising:

(a) a resilient body having opposite first and second principal surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, and first and second planar surface portions respectively extending on opposite sides of said concave surface portion and lengthwise in a direction parallel to said opposing edges of said first and second principal surfaces; and (b) a fluid impermeable coating covering said first principal surface and covering at least a portion of said at least one of said plurality of side surfaces;

wherein a first side surface of a first one of said panels is adhered to a second side surface of a second one of said panels such that opposing concave surface portions of said first and second side surfaces define a void extending lengthwise between said first and second panels;

wherein each of said first and second side surfaces further includes a third planar surface portion extending widthwise at an angle relative to said first planar surface portion of a corresponding one of said first and second panels and extending lengthwise between an edge of said first principal surface and said first planar surfae portion of a corresponding one of said first and second panels, and wherein said third planar surface portions of said first and second side surfaces together define a groove extending lengthwise between said first principal surfaces of said first and second panels; and wherein said fluid impermeable coating further covers said third planar surface portions of said first and second side surfaces.

8. A padded enclosure as claimed in claim 7, further comprising at least one of a sealant and an adhesive located within said groove and along a length of said groove.

9. A padded enclosure as claimed in claim 7, further comprising a flexible bead located within said groove and along a length of said groove.

10. A padded enclosure comprising an interior surface which is at least partially sheathed by a plurality of panels, each of said panels comprising:

(a) a resilient body having opposite first and second principals surfaces, and a plurality of side surfaces extending between opposing edges of said first and second principal surfaces, wherein at least one of said plurality of side surfaces includes a concave surface portion extending lengthwise in a direction parallel to said opposing edges of said first and second principal surfaces, and first and second planar surface portions respectively extending on opposite sides of said concave surface portion and lengthwise in a direction parallel to said opposing edges of said first and second principal surfaces; and (b) a fluid impermeable coating covering at least one of said first and second principal surfaces and covering at least a portion of said at least one of said plurality of side surfaces;

wherein a first side surface of a first one of said panels is adhered to a second side surface of a second one of said panels such that opposing concave surface portions of said first and second side surfaces define avoid extending lengthwise between said first and second panels;

wherein said first and second side surfaces of said first and second panels have complementary positive and negative slants.

* * * * *